US008221859B2

(12) United States Patent
Ledger et al.

(10) Patent No.: US 8,221,859 B2
(45) Date of Patent: Jul. 17, 2012

(54) CLEANING WIPE AND METHOD GIVING WATER STAINING RESISTANCE

(75) Inventors: Christopher Ledger, Hull (GB); Lynne Swainger, Hull (GB)

(73) Assignee: Reckitt Benckiser (UK) Limited, Berkshire (GB)

( * ) Notice: Subject to any disclaimer, the term of this patent is extended or adjusted under 35 U.S.C. 154(b) by 477 days.

(21) Appl. No.: 10/518,800

(22) PCT Filed: Jun. 20, 2003

(86) PCT No.: PCT/GB03/02653

§ 371 (c)(1),
(2), (4) Date: Dec. 20, 2004

(87) PCT Pub. No.: WO04/000989

PCT Pub. Date: Dec. 31, 2003

(65) Prior Publication Data

US 2005/0202190 A1 Sep. 15, 2005

(30) Foreign Application Priority Data

Jun. 21, 2002 (GB) ..... 0214343.6

(51) Int. Cl.
*C11D 17/04* (2006.01)
*C11D 1/83* (2006.01)

(52) U.S. Cl. ..... 428/34.7; 510/214; 510/242; 510/438; 510/439; 428/36.1

(58) Field of Classification Search ..... None
See application file for complete search history.

(56) References Cited

U.S. PATENT DOCUMENTS

| | | | | |
|---|---|---|---|---|
| 4,963,432 | A * | 10/1990 | Fuggini et al. | 442/165 |
| 5,141,803 | A | 8/1992 | Pregozen | 428/288 |
| 5,700,768 | A * | 12/1997 | Lu | 510/214 |
| 5,763,332 | A | 6/1998 | Gordon et al. | 442/84 |
| 6,669,763 | B1 * | 12/2003 | Ghodoussi | 106/10 |
| 2003/0109395 | A1 * | 6/2003 | Neumiller | 510/246 |

FOREIGN PATENT DOCUMENTS

| | | | |
|---|---|---|---|
| EP | 0 317 897 | | 31/1989 |
| EP | 0 392 316 | | 17/1990 |
| EP | 0365160 | A2 | 4/1990 |
| EP | 0878564 | A1 | 11/1998 |
| GB | 2 328 451 | A | 24/1999 |
| GB | 1067462 | | 3/1967 |
| RU | 2068864 | | 10/1996 |
| SU | 763421 | | 15/1980 |
| WO | WO99/37747 | A1 | 7/1999 |

OTHER PUBLICATIONS

International Preliminary Examination Report for Application No. PCT/GB03/02653 dated Oct. 13, 2004.
International Search Report for Application No. PCT/GB03/02653 dated Oct. 15, 2003.
Database WPI; Section Ch, Week 198122; Derwent Publications Ltd., London, GB; AN 1981-39721D; XP002256261 & SU 763 421 A (Mosc Chem Ind Inst), Sep. 15, 1980, abstract.
Database WPI; Section Ch, Week 199726; Derwent Publications Ltd., London, GB; AN 1997-287889; XP002256262 & RU 2 068 864 C (Egorov N K), Nov. 10, 1996, abstract.
Derwent Abstract No. 1996-1859998 relating to JP08059998 (Asahi) Mar. 5,1996.
Combined Search and Examination Report from the Patent Office in Great Britain dated Jan. 21, 2003 for Application GB 0214343.6.

* cited by examiner

*Primary Examiner* — Rena Dye
*Assistant Examiner* — Ellen S Wood
(74) *Attorney, Agent, or Firm* — Norris McLaughlin & Marcus PA

(57) ABSTRACT

The invention provides a moist wipe for cleaning a surface, the wipe comprising a sheet material premoistened with an aqueous emulsion comprising a wax and no or a low amount of silicone compounds. The wipe is used to wipe a surface, to prevent or reduce against water staining on the surface, as might arise from subsequent contact with aqueous liquids. The invention further provides a packaged product containing at least one wipe, and a method of manufacturing moist wipes.

10 Claims, No Drawings

CLEANING WIPE AND METHOD GIVING WATER STAINING RESISTANCE

This application is a national phase filing of PCT/GB2003/0026523 filed Jun. 21, 2003.

The present invention relates to a sheet material—a wipe—for cleaning a surface, leaving a water-resistant layer. In particular it relates to a wipe which is impregnated with a cleaning composition which reduces or prevents the formation of water stains.

It is known that if aqueous liquid compositions (hereinafter collectively called "water" for convenience), collect on wooden surfaces, especially certain lacquered or varnished wooden surfaces, it may cause water staining. The water staining may be in the form of white rings. Consequently, any water on such surfaces is generally removed as soon as possible. However, if the water has contacted the surface for too long, water staining may occur. Once it has occurred it is known to try to mask, reduce or remove it, using specialist procedures or chemical agents. Drastic measures may sometimes be undertaken, for example, removing the stained region and exposing fresh unstained material beneath, then restoring any surface coating. If chemical agents are used to mask or remove the staining, the chemical agents may be toxic and environmentally unsafe, and frequently the masking or stain removal is not complete.

Commercially available cleaning compositions are not perceived to prevent water staining and there are indications that some may even promote water staining.

It is preferable to prevent staining of a surface caused by contact with water, than to seek to cure the problem when it arises. It is desirable to do this in a way which does not mask the appearance of the surface (frequently an item of furniture, for example a table, desk, chest or shelf).

According to a first aspect of the present invention there is provided a moist wipe for cleaning a wooden surface, the wipe comprising a sheet material pre-moistened with a liquid composition, being an aqueous emulsion comprising from 0.01 to 5% of a wax and no silicone compounds or silicone compounds in an amount of less than 0.5%, in each case by weight of the total weight of the liquid composition.

By "wax" we mean a water-repellent low-melting organic material useful in laying down a stable inert coating on a surface. Suitable waxes include hydrocarbons and esters of fatty acids and alcohols.

By "pre-moistened" we mean that the wipe is moistened not immediately prior to its use in cleaning a surface. Generally the wipe is "pre-moistened" as part of its manufacture. Moistening a cleaning cloth during cleaning is not a "pre-moistened wipe" in accordance with this invention.

Percentage values quoted above denote the total complement of such components which are present; there may be more than one.

In use, the target surface is contacted with the moist wipe, which is drawn across the surface. It thereby cleans the surface and lays down wax onto the surface. The wax inhibits the formation of water stains on the surface if water is subsequently contacted with the surface.

Suitably the wax is present as an emulsion in the liquid composition. Good results have been obtained in a non-ionic aqueous emulsion.

Particularly preferred as a wax in the invention is paraffin wax.

Paraffin waxes generally have a macrocrystalline structure and consist largely of n-alkanes of formula $C_{20}H_{42}$ and upwards, with some iso- and cycloalkanes.

Suitably the wax is present in the composition in an amount of between 0.01% to 5%. Preferably the wax is present in an amount of at least 0.05%, and most preferably at least 1%, by weight of the total weight of the liquid composition.

Preferably the wax is present in an amount up to 3%, and most preferably up to 1%, by weight of the total weight of the liquid composition.

Suitably the liquid composition is an aqueous composition that includes water in an amount of at least 50%, preferably at least 70%, and more preferably at least 80%, by weight of the total weight of the liquid composition.

Suitably the liquid composition is an aqueous composition that includes water in an amount of up to 98%, most preferably up to 95%, by weight of the total weight of the liquid composition.

Preferably the liquid composition includes, as a carrier and/or a cleaner, an aliphatic $C_1$ to $C_4$ alcohol, more preferably ethanol.

Preferably the alcohol is present in an amount of at least 0.5%, more preferably at least 2%, most preferably at least 5% by weight of the total weight of the liquid composition.

Preferably the alcohol is present in an amount of up to 20%, more preferably up to 15%, most preferably up to 10% by weight of the total weight of the liquid composition.

The liquid composition may also include other optional ingredients which are well known to those skilled in the art, such as preservatives, for example chlormethylisothiazoline, 1,2-benzisothiazolinone, buffering agents and fragrances.

The liquid composition may comprise a silicone compound in a small amount. Most preferably the liquid composition does not comprise a silicone compound.

Suitably the liquid composition contains an anti-static compound, preferably an anti-static amphoteric compound.

The liquid composition may contain an anti-static agent and an amphoteric surfactant, as distinct components. Alternatively or additionally it may contain an amphoteric surfactant which has anti-static properties.

Suitable amphoteric surfactants which can be used in the cleaning composition include amphoteric betaine surfactants having anti-static properties.

A preferred, the amphoteric surfactant is an alkyl amino betaine or an alkyl amido betaine.

Suitable amphoteric surfactants also include cocoamides having anti-static properties, most preferably polyoxyethylene-3-cocoamide.

Suitable amphoteric surfactants also include imidazoline surfactants having anti-static properties, for example sodium capryloamphopropionate (CAS No. 68877-55-4).

Suitable amphoteric surfactants include lactamide surfactants having anti-static properties, for example Lactamide MEA (CAS No. 5422-34-4).

Particularly good anti-static results have been found with compositions containing a betaine in combination with a cocoamide.

Preferably, an anti-static compound may be present in an amount of at least 0.05%, and most preferably at least 0.1%, by weight of the total weight of the cleaning composition.

Preferably, an anti-static compound may be present in an amount of up to 10%, more preferably up to 5%, and most preferably up to 2%, by weight of the total weight of the cleaning composition.

Without being bound by any theory, it is believed that the water-resistance of a wooden surface may be compromised by silicone compounds, and/or by compounds used in their emulsification.

The sheet material may be any sheet material capable of carrying and delivering the liquid composition, and may be porous, absorbent and/or fibrous in structure.

Preferably the sheet material is a fibrous sheet material.

The sheet material could in principle be woven, but is preferably non-woven. For example, the sheet material may include non-woven sheet materials such as melt blown, coform, air-laid, bonded-carded web materials, hydro-entangled materials and combinations thereof.

Preferably, the sheet material is a non-woven fibrous sheet material comprising synthetic and/or natural fibres. Most preferably, the non-woven fibrous sheet material comprises viscose and/or rayon fibres.

Typically, the sheet material (dry) has a weight of at least 20 grams per square metre ($gm^{-2}$), preferably at least 30 $gm^{-2}$, and most preferably at least 40 $gm^{-2}$.

Typically the sheet material (dry) has a weight of up to 80 $gm^{-2}$, more preferably up to 70 $gm^{-2}$, and most preferably up to 60 $gm^{-2}$.

A particularly preferred sheet material has a weight of approximately 50 $gm^{-2}$.

Preferably, the wipe has a size in the range 10 to 40 cm by 10 to 40 cm, more preferably in the range 15 to 35 cm×15 to 35 cm.

Preferably the loading of the liquid composition on the wipe is at least 30 $gm^{-2}$, and most preferably at least 50 $gm^{-2}$.

Preferably the loading of the liquid composition on the wipe is up to 150 $gm^{-2}$, and most preferably up to 100 $gm^{-2}$.

Preferably, each individual wipe is loaded with at least 3.5 g of the composition.

Preferably, each individual wipe is loaded with up to 5.5 g of the composition.

Most preferably each wipe is loaded with approximately 5 g of the composition. Advantageously, it has been found that this level of loading provides a wipe of size and grammage outlined above with sufficient moisture so that it does not dry out but which is not too wet to cause smearing in use.

In a particularly preferred embodiment each individual wipe has a size of approximately 20×30 cm using a sheet material having a weight (dry) of 50 $gm^{-2}$, and is loaded with about 5 g of the composition.

According to a second aspect, the present invention provides a packaged product comprising a substantially airtight container having a resealable opening and containing a wipe of the first aspect.

The container could be a tub or a soft-pack in the form of a pouch (hereinafter a "wrap"). Preferably, the container includes a plurality of wipes which are arranged in a generally folded configuration in a stack so that each wipe can be removed from the container one at a time. Such folded configurations well known to those skilled in the art and include C-folded, Z-folded, quarter-folded configurations and the like. Each wipe may be interfolded with the wipe immediately above and below in the stack of wipes so that the action of withdrawing one wipe raises a part of the wipe underneath it, to assist its removal. Alternatively the wipes may rest on each other in a stack without being interleaved.

Alternatively, wipes could be wound as a roll and separated by perforated tear zones and the container could be a tub having an opening through which wipes are pulled.

According to a further aspect, the present invention provides the use of the wipe as defined hereinbefore for cleaning a surface, for example of furniture. Preferably, the wipe is used to clean surfaces of glass, wood, plastics and the like. The benefit of the invention in resisting water stains is of primary value in relation to wooden surfaces, by which term we include certain lacquered or varnished wooden surfaces.

According to a still further aspect, the present invention provides a method of manufacturing a wipe as defined hereinbefore, the method comprising the steps of providing a sheet material as defined hereinbefore and as part of the manufacture of the wipe moistening the sheet material with a liquid composition as defined hereinbefore.

Preferably, in the manufacturing method, a supply roll of sheet material is unwound to provide a continuously moving web of material. The web of material is saturated or otherwise impregnated with the liquid cleaning composition by any suitable means such as spraying, dipping, or the like as are well known to those skilled in the art. In a particular aspect, the web of material is passed over several perforated tubes which feed the solution into the material.

In another embodiment a roll or stack of wipes is put in the container dry, and the liquid cleaning composition is injected into the container, to impregnate the wipes.

In one embodiment the web of material is slit in the machine direction into multiple ribbons, each of which may be folded into the type of fold desired for the individual wipe. The web of material is slit using a cutter, as is well known to those skilled in the art.

In a related method a wide roll of material is cut into a number of shorter rolls. A plurality of such shorter rolls are unwound at the same time. If wished the longitudinal edges of the unrolling webs (the edges parallel to the direction of unrolling) are folded over against the central region of the webs. The unrolling webs are brought together in face-to-face manner and then cut at intervals, to form stacks ready to be packaged. In principle impregnation could be at any stage but in a preferred embodiment it is the individual unrolling webs which are impregnated, for example by spraying or dipping.

A resulting stack of wipes may be placed in a container, such as a plastics wrap or a tub, to provide a package of wipes. The container provides a substantially hermetically sealed environment for the wipes to minimise the escape of the liquid composition, by evaporation or otherwise.

The invention will now be described further with reference to the following non-limiting examples.

The following materials were used in the examples:

IMS 99—ethanol, 96% pure, from IMS (Industrial Methylated Spirits)

Proxel GXL—a liquid preservative comprising 1,2-benzisothiazolinone and sodium hydroxide, from Avecia, UK Ultralube E 342/45—a water based anionic emulsion of paraffin wax, from Keim Additec, Germany Rhodorsil EIP—a poly(dimethylsiloxane) which is pre-formulated which an anionic surfactant to form a slightly anionic oil-in-water aqueous emulsion having 35 wt % of the siloxane, and which is available from Rhodia Chemie, France.

The wipes were of highly tangled non-woven blend of natural and man-made fibres and are sold as DEXTER 12106, by Alstrom-Dexter. The wipes were of grammage 50 $gm^{-2}$, and individual wipes were rectangles of size approximately 20 cm×30 cm. The wipes were pre-moistened with the liquid cleaning compositions defined below. The loading of the compositions was 5 g per wipe. This was sufficient to fully impregnate the wipes.

Wipes A were pre-moistened with Formula A below.

FORMULA A

| Component | % w/w |
|---|---|
| Deionized water | 92.39 |
| IMS 99 | 6.7 |
| Ultralube E 342/45 Wax Emulsion | 0.56 |

-continued

| FORMULA A | |
|---|---|
| Component | % w/w |
| Prolemon Fragrance | 0.2 |
| Proxel GXL | 0.15 |

Wipes B were of the same non-woven material impregnated with Formula B, a control composition comprising the following ingredients.

| FORMULA B | |
|---|---|
| Component | % w/w |
| Deionized water | 91.55 |
| IMS 99 | 6.5 |
| Proxel GXL | 0.15 |
| Prolemon Fragrance | 0.2 |
| Sodium capryloamphopropionate | 0.3 |
| Lactamide MEA | 0.3 |
| Rhodorsil EIP | 1.0 |

Wipes C were PLEDGE® cleaning wipes from SC Johnson. These are believed to be impregnated with water, solvent and approximately 7% wt/wt of silicone compound(s).

The effect of using Wipes A, B and C were also compared with the effect of not wiping the surface to be tested.

The following procedure was used:

A sanded wooden surface painted black to aid visual assessment and with a shellac coating was prepared by cleaning and drying until no moisture was present on the surface. A shellac coating was used as such surfaces are known to give white water stain marks when contacted with water for a prolonged period, and left untreated. The surface was marked such that it was divided into equal rectangular sections, using masking tape. Different sections were tested either with Wipes A, B and C or without using a wipe. For sections tested by wiping with Wipes A, B and C the following protocol was used. Each section of the surface was wiped with a wipe by moving the wipe up and down the rectangular section five times, then moving the wipe left and right across the rectangular section five times, ensuring complete coverage of the section. The sections that had been wiped were then left for 1 hour, before one milliliter of deionised water at 5° C. was pipetted onto all of the rectangular sections, so as to form a small pool of water in the centre of each section. 100 ml glass beakers were then filled with 75 ml of tap water and one ice cube, and a beaker placed over each of the pools of water on each section of the surface, ensuring that all the water was enclosed underneath the beaker.

The pools of water covered by the beakers were left for 7 hours, before the beakers were removed from the surface. The remaining water on each of the sections was removed as follows: a clean dry dusting cloth was wrapped around a rubbing block and, using firm strokes, wiped on each section eight times in a downward direction, then a second clean duster was wrapped around a rubbing block and wiped across each section eight times horizontally across each section. The surface was then left overnight (for a minimum of 16 hours) for any water stains to fully form.

The intensity of any water stains formed was evaluated by using the following method:

A panel of people using a blind scoring system was assembled. In the scoring system, 0 represented no staining and 4 represented severe staining of each rectangular section of the surface. Standard water staining marks were available for reference to the panel. The number of panellists was sixteen panellists per rectangular section tested, and each surface tested had two rectangular sections wiped by a Wipe A, two rectangular sections wiped by a Wipe B, and two rectangular sections wiped by a Wipe C, and two control rectangular sections which were not treated before the addition the water. Furthermore, two surfaces were tested in the above manner, to repeat the experiment.

In each evaluation of each rectangular section, it was ensured that each member of the panel was standing in exactly the same position, so the board was always viewed under the same lighting conditions.

The average of the experiments are shown in Table 1 below.

| Test Method | Average Score - 0 to 4 (0 = no marking, 4 = severe watermarking) |
|---|---|
| Wipe A | 0.66 |
| Wipe B | 1.24 |
| Wipe C | 3.34 |
| Untreated surface | 1.15 |

The results show that pre-treatment of a surface by wiping with pre-moistened Wipes A showed an excellent preventive effect in relation to water staining. The surface treated with Wipes B, in which the composition contained a small loading of a silicone compound instead of a wax emulsion, showed a markedly lower effect than Wipes A in preventing white water stains, and slightly increased water staining compared with an untreated surface. Wipe C, believed to have a much higher silicone loading, showed considerably increased water staining, in these tests.

The invention claimed is:

1. A moist wipe for cleaning a wooden surface to reduce or prevent the formation of water stains, the wipe comprising a sheet material pre-moistened with a liquid composition, said liquid composition being an aqueous emulsion consisting of:

0.01-5% wt. of a paraffin wax, 0-10% wt. of an anti-static compound, 0.5% wt.-20% wt. of an aliphatic $C_1$-$C_4$ alcohol carrier or cleaner;

0-0.2% wt. of a fragrance;

optionally a preservative;

optionally an amphoteric surfactant;

and the remainder to 100% wt. with water in an amount of at least 80% wt., wherein no silicone compounds are present in said liquid composition.

2. A moist wipe as claimed in claim 1 wherein the wax is present in the composition in an amount of between 0.05% to 3% by weight of the total weight of the liquid composition.

3. A moist wipe according to claim 1 wherein the liquid composition includes, as a carrier and/or a cleaner, an aliphatic $C_1$ to $C_4$ alcohol.

4. A moist wipe according to claim 1 wherein the sheet material comprises a porous, absorbent, non-woven fibrous material.

5. A moist wipe according to claim 1 wherein the loading of the liquid composition on the wipe is in the range of 30 to 150 grams/$cm^2$.

6. A packaged product comprising a substantially airtight container having a resealable opening and a wipe according to claim 1.

7. A method of treating a surface, said method comprising the step of: providing a wipe according to claim 1 and, drawing the said wipe across a surface.

8. A method of manufacturing a wipe according to claim 1, the method comprising the steps of providing a sheet material and moistening the sheet material with the liquid composition.

9. A method according to claim 8 wherein a supply roll of sheet material is unwound to provide a continuously moving web of material.

10. A method according to claim 9 wherein the web of material is slit to form perforated tear zones, or individual wipes in the form of a stack.

* * * * *